US007008355B2

(12) United States Patent
Emick

(10) Patent No.: US 7,008,355 B2
(45) Date of Patent: Mar. 7, 2006

(54) SAFETY STRAP FOR LIFTING BARBELLS AND DUMBBELLS

(76) Inventor: Daniel W. Emick, Rear 514, Weldon St., Montoursville, PA (US) 17754

( * ) Notice: Subject to any disclaimer, the term of this patent is extended or adjusted under 35 U.S.C. 154(b) by 294 days.

(21) Appl. No.: 10/676,515

(22) Filed: Oct. 1, 2003

(65) Prior Publication Data

US 2005/0075227 A1 Apr. 7, 2005

(51) Int. Cl.
*A63B 21/00* (2006.01)

(52) U.S. Cl. ..... 482/139; 482/105; 2/16; 2/161.1

(58) Field of Classification Search ..... 482/44, 482/105, 106, 139; 2/16, 161.1, 20
See application file for complete search history.

(56) References Cited

U.S. PATENT DOCUMENTS 4,487,412 A 12/1984 Meeko
4,684,122 A 8/1987 Desmond et al.
4,807,876 A 2/1989 Lothar
5,004,231 A 4/1991 Alread
5,081,715 A 1/1992 Mascia
5,350,343 A 9/1994 DaSilva
5,813,950 A 9/1998 Parker

*Primary Examiner*—Glenn E. Richman
(74) *Attorney, Agent, or Firm*—Thomas R. Shaffer, Esq.

(57) ABSTRACT

A safety strap for lifting barbells and dumbbells includes a wrist strap which is wrapped around and secured to the wrist of a user. A tongue is attached to said wrist strap which extends toward an open palm of a hand of the user. The tongue has a plurality sleeves which may receive a lifting hook member. The lifting hook member has a central portion and a pair of hooks. Each hook has a connection point located on a line of pull, an angled portion extending inwardly away from said line of pull and closer to the palm of a user, a downwardly extending portion, and an arcuate portion having an approximate midpoint positioned on said line of pull. With this arrangement, a bar positioned on the pair of hooks will remain at the approximate midpoint of said arcuate portions when lifted by said pair of hooks.

14 Claims, 4 Drawing Sheets

SAFETY STRAP FOR LIFTING BARBELLS AND DUMBBELLS

BACKGROUND OF THE INVENTION

1. Field of the Invention

The present invention relates to a safety strap for lifting barbells and dumbbells. More specifically, the present invention relates a wrist strap including a pair of hooks wherein a bar positioned on said pair of hooks will remain at the approximate midpoint of said hooks when lifted by said pair of hooks.

2. Prior Art

A variety safety strap devices are known in the art. Such wrist wrapping devices commonly employed by resistance exercisers to aid in maintaining hold of barbells, dumbbells, weight machine armatures (i.e. resistance implements) during pulling exercise movements performed to target upper body muscles of the back, shoulders, trapezius, etc. The dominance of size and strength of these muscle groups commonly exceeds that of hands and their ability to maintain grip thus creating a "weak link" in the line of pull between muscles and resistance in its various forms. The inability of a user to sufficiently load the targeted muscle groups and bypass the "quick to fatigue" lesser muscles of the forearm and hand has spawned the birth of various "full grip" and "semi grip" wrist strap designs.

An early attempt to solve this problem was with the use of what are commonly referred to as "lifting straps". A lifting strap is a simple device comprised of nylon or cotton strapping material which is elaborately wrapped around the hand of the user. Such wrist primary benefits are simplicity of design, ability to accommodate multiple hand sizes and the security of a no slip wrist wrap commensurate with slip knot tendencies to draw tighter in direct proportion to amount of resistance used and speed of exercise movement. The primary drawbacks of such devices are the inconvenience and tedious "wrapping" procedure which can consume a good portion of one's "between set" recovery period which time would be better spent resting and preparing for concurrent bouts of exercise. The risk and discomfort of the slip joint design and its constrictive nature impose severe stress on delicate wrist and hand connective tissue and blood vessels. Additionally, user must retain a tight grip on item at all times during the exercise movement to retain grip. This disallows the preferred "semi-open grip", which prevents undue fatigue of hand and forearm while simultaneously ensuring maximal contraction of targeted muscle groups.

One known device is shown in FIG. 1 which shows a wrist band 5 with a single hook 10. Another device is shown in FIG. 2 which has a wrist band 15 with a double hook member 20. Both of these devices are useful but, in each case, the line of pull P is such that a bar tends to tip off the hook when force is applied.

FIG. 3 shows another prior art device which includes a padded Velcro wrist band 25 with an attached strap 30 which may be wrapped around a bar B-1 in the same manner as conventional lifting straps. Such a device is useful in that the user's ability to secure a non-constricting, fixed wrist wrap snug enough to resist slippage can be accomplished without incurring the joint tissue stress associated with traditional lifting straps. Additionally, such a device delivers multiple user capacity and a secure closed fisted implement hold. Drawbacks to this design are the tedious resistance implement wrapping procedure common to traditional lifting straps and the need for the user to keep his/her hand tightly closed over strapped and wrapped resistance implement.

Such a close fisted grip disallows user the option of utilizing the preferred "semi open" hand grip that minimizes biceps and forearm involvement while maximizing users ability to effectively target the desired muscles of back and shoulders.

Various other specific prior art devices are also known. Meeko, U.S. Pat. No. 4,487,412 includes a wrist band with a single hook. Similarly, Lothar, U.S. Pat. No. 4,807,876 discloses a lift assistance device including a wrist cuff 1 to which a single hook 22 is attached. Desmound, U.S. Pat. No. 4,684,122 discloses a cuff device having a hook portion 40. The hooks of these device have the same problems as described herein with respect to the prior art device of FIG. 1, namely, that the bar would tend to tip off such hooks because of the design of the hook.

Alread, U.S. Pat. No. 5,004,231 discloses a padded exercise glove incorporating lifting straps 24 and 25. Such a device is overly complex and needs to be individually sized to the user to be effective.

DeSilva, U.S. Pat. No. 5,350,343 discloses and hand gripping devise which has a hand pad formed of neoprene with a non-slip surface on one side. Parker, U.S. Pat. No. 5,813,950 discloses a grip assist apparatus which has a wrist band portion 58, 59 and a palm portion 20. Such devices are useful for a full grip lift but not for semi open grip.

Mascia, U.S. Pat. No. 5,081,715 discloses a palm protector and is of only general interest.

SUMMARY OF THE INVENTION

The present invention provides a safety strap for lifting barbells and dumbbells which comprises:

a) a wrist strap adapted to be wrapped around and secured to the wrist of a user;

b) a tongue attached to said wrist strap and adapted to extend toward an open palm of a hand of the user, said tongue having at least one sleeve therein adapted to receive a lifting hook member;

c) a lifting hook member having a central portion and a pair of hooks, with one hook attached at each opposite end of said central portion, each hook having a connection point located on a line of pull, an angled portion extending inwardly away from said line of pull and closer to the palm of a user, a downwardly extending portion, and an arcuate portion having an approximate midpoint positioned on said line of pull, whereby a bar positioned on said pair of hooks will remain at the approximate midpoint of said arcuate portions when lifted by said pair of hooks.

Preferably, said at least one sleeve comprised plural sleeves each sleeve located at a different distance from said wrist strap whereby a user may insert a lifting hook member into a desired one of said plural sleeves to accommodate user's with different length hands and to allow a user to place the lifting hook member at a location which is most comfortable for the user.

Preferably the safety strap also includes a bar strap adapted to extend from the wrist strap over the palm and toward the finger tips of a user, whereby said bar strap may be spiraled around a bar to be lifted to aid the user in gripping and holding the bar or may be folded upward and affixed to wrist strap (via Velcro tab on end) when user opts to utilize hooks.

Preferably, said lifting hook member may be removed from said at least one sleeve and removably inserted into one of said at least one sleeves.

Preferably, said angled portion is oriented at an angle of approximate 40 degrees relative to said line of pull.

Preferably, said arcuate portion extends along an arcuate distance of at least approximately 130 degrees and more preferably an arcuate distance of approximately 180 degrees.

Preferably, said downwardly extending portion is spaced apart from and parallel to said line of pull and is collinear with said line of pull.

Preferably, said wrist strap is removably secured to the wrist of a user with Velcro fasteners and wrist strap and said tongue are formed of a flexible material such a nylon fabric.

The lifting hook member is preferably formed of steel. Preferably, said lifting hook member is adapted to be inserted into one of said at least one sleeve by pushing an end of one hook and the entire hook through the sleeve whereby the sleeve covers said central portion.

DETAILED DESCRIPTION OF THE PREFERRED EMBODIMENTS

Figure 1:
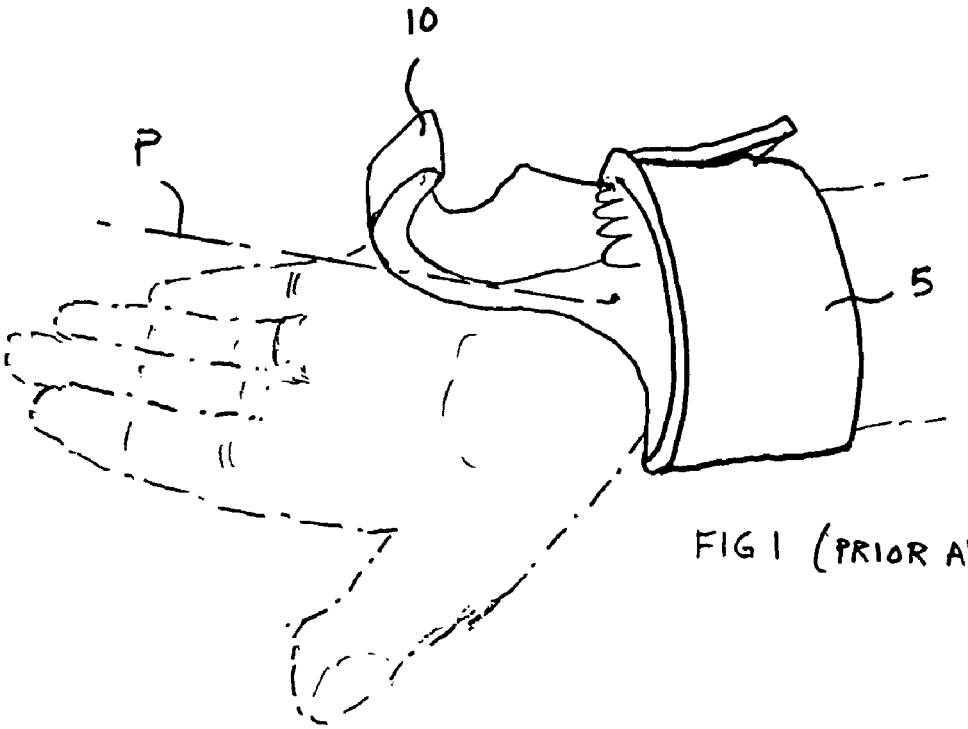
FIG 1 (PRIOR ART)
FIG. 1 is a perspective view of a prior art device having a wrist strap and a single hook.
Figure 2:
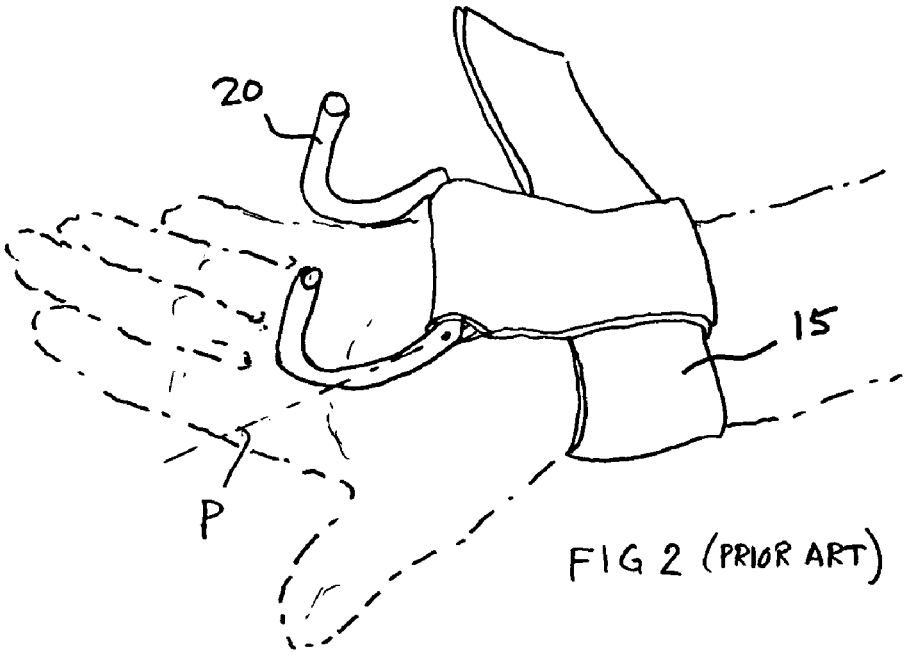
FIG 2 (PRIOR ART)
FIG. 2 is a perspective view of a prior art device having a wrist strap and a double hook.
Figure 3:
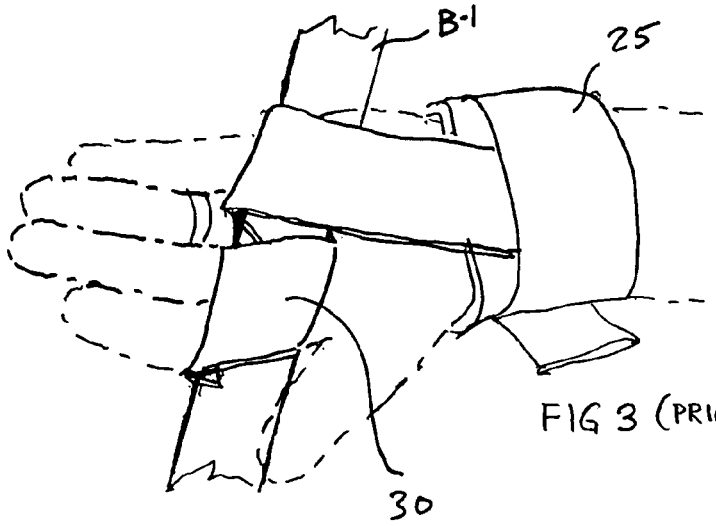
FIG 3 (PRIOR ART)
FIG. 3 is a perspective view of a prior art device having a wrist strap and a lifting strap.
Figure 4:
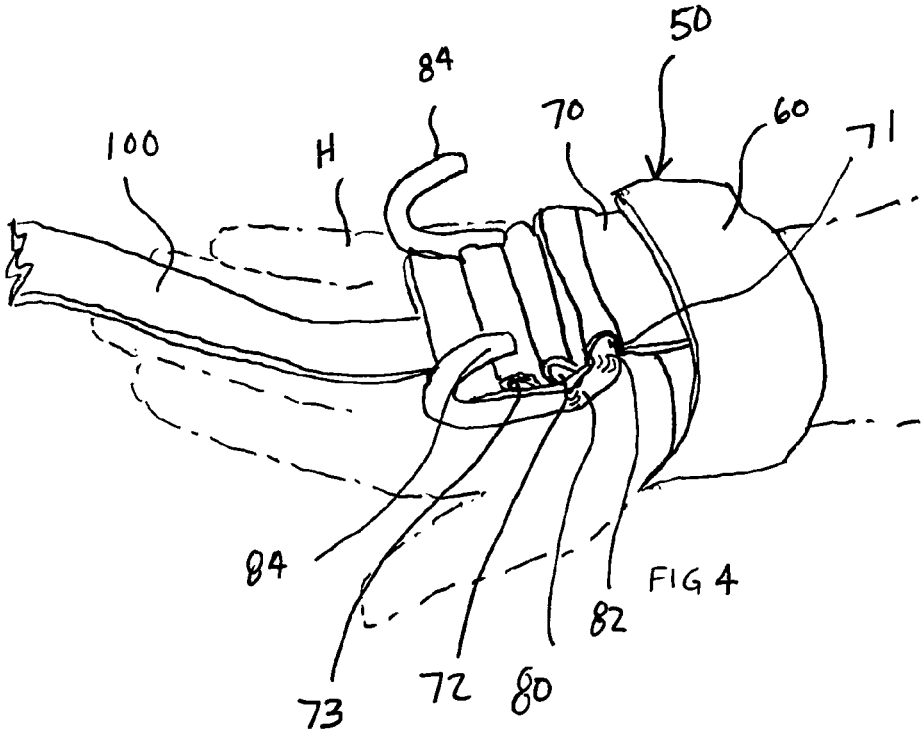
FIG. 4 is a perspective view of the safety strap of the present invention as attached to the wrist of a user.

Prior art FIGS. 1 through 3 have been described above.

Referring to FIG. 4–8, a safety strap 50 is provided. The safety strap 50 includes a wrist strap 60 which is adapted to be wrapped around and secured to the wrist of a user, preferably by the use of Velcro fasteners. A tongue 70 is attached to the wrist strap 60 which extends toward an open palm of the hand H of a user. Tongue 70 has three sleeve portions 71, 72 and 73, each of which is adapted to receive a lifting hook member 80. As can be best seen in FIG. 4, this allows for an adjustment of a lifting hook member 80 relative to the palm of the hand H of the user. The lifting hook member 80 has a central portion 82, an angled portion 86, a downwardly extending portion 88 and an arcuate portion 90. The arcuate portion 90 has an approximate midpoint 92 positioned along a line of pull P.

Figure 5:
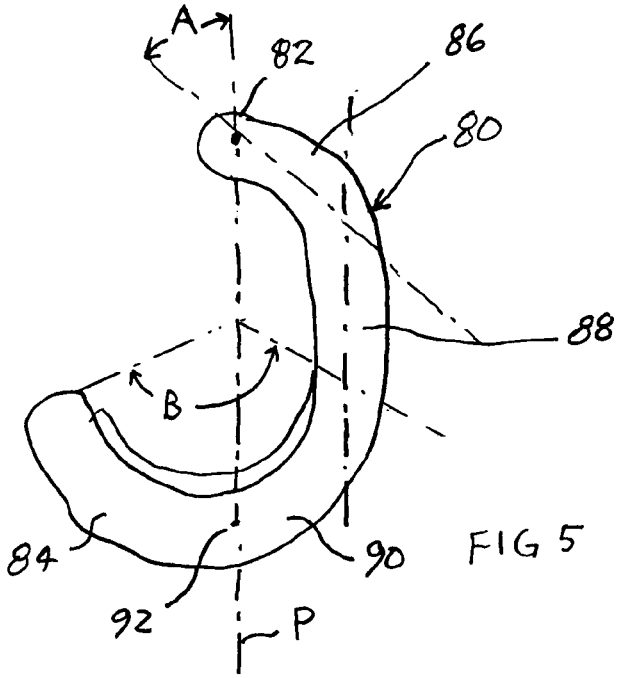
FIG. 5 is a side elevation view of the lifting hook member of the present invention.
Figure 6:
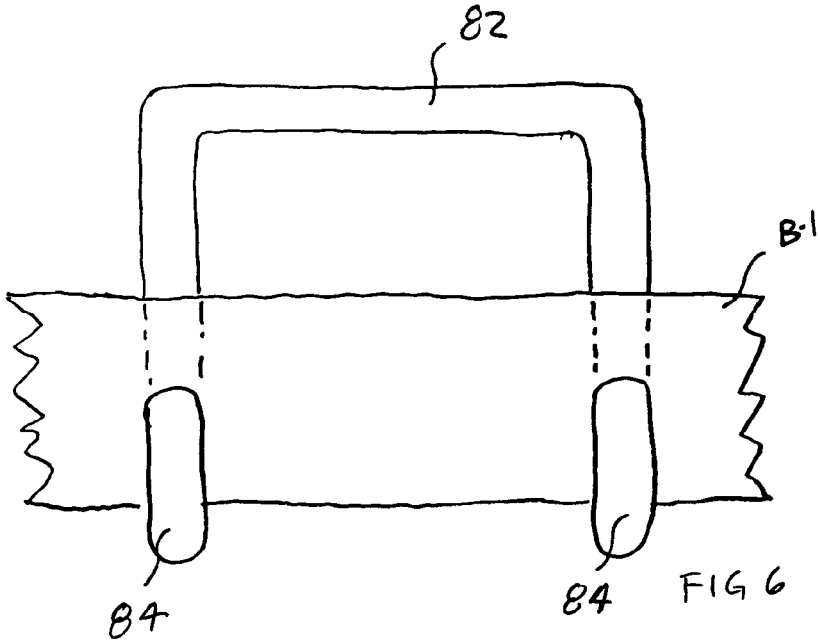
FIG. 6 is front elevation view of the lifting hook member of the present invention supporting a barbell bar.
Figure 7:
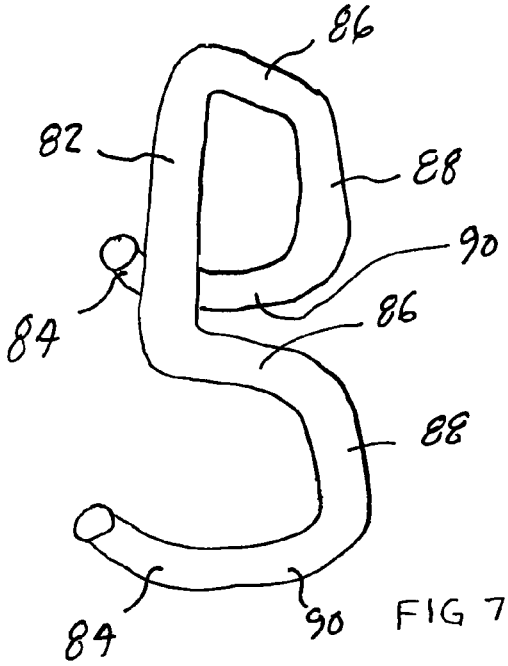
FIG. 7 is a perspective view of the lifting hook member of the present invention.
Figure 8:
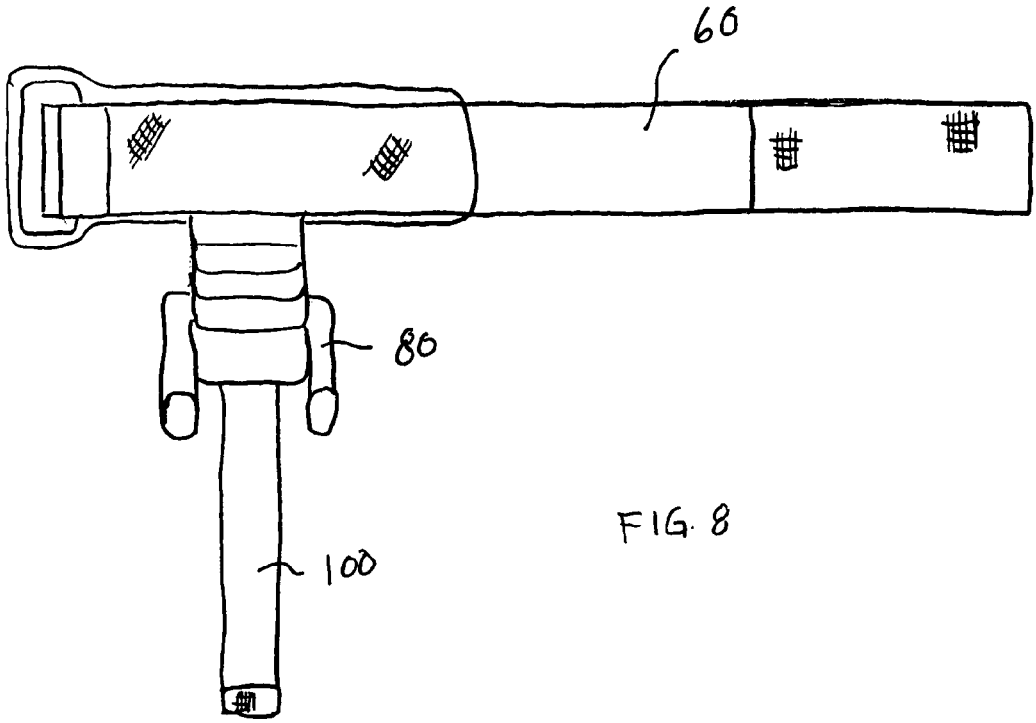
FIG. 8 is a top plan view of the safety strap of the present invention.

Referring to FIG. 5, the angled portion 86 is oriented at an angle A of approximately 40 degrees relative to said line of pull P. Further, said arcuate portion 90 preferably extends an arcuate distance B of at least 130 degrees and preferably an arcuate distance of approximately 180 degrees. As can be seen in FIG. 5, the downward extending portion 88 is positioned parallel to the line of pull P and is spaced apart therefrom. As can be seen, the lifting hook member 80 has a pair of hooks 84 formed on opposite ends thereof.

The present invention provides significant benefits over the devices used in the past. More specifically, because the lifting hook 80 may be placed into any one of the plurality of sleeves 71, 72 and 73, the lifting hook member 80 may be adjusted to be in the proper location in the palm P of the hand H of the user even for users with varying sizes of hands. The present invention may be utilized with the lifting hook member 80 for a "semi-grip" style of lifting wherein the user need not tightly grip the bar at all times.

Additionally, the present invention provides an additional benefit in that the lifting hook member 80 may be removed completely from the device and the device may still be utilized with strap member 100 being utilized in the same manner as strap member 30 as shown in the prior art device showing FIG. 3. Thus, the present invention, while allowing the use of a lifting hook member 80 also allows for the device to function in a traditional manner as lifting strap. Utilizing the strap portion 100 to wrap around the bar of a barbell or dumbbell allows the user to lift weights with a "full grip" lifting style wherein the user fully grips onto the bar at all times during the lifting operation. Accordingly, it can be seen that the present invention provides the user with a number of options regarding how the device may be utilized as well as a means to adjust the device to property fit the size of the user's hand.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A safety strap for lifting barbells and dumbbells comprising:

a) a wrist strap adapted to be wrapped around and secured to the wrist of a user;

b) a tongue attached to said wrist strap and adapted to extend toward an open palm of a hand of the user, said tongue having at least one sleeve therein adapted to receive a lifting hook member;

c) a lifting hook member having a central portion and a pair of hooks, with one hook attached at each opposite end of said central portion, each hook having a connection point located on a line of pull, an angled portion extending inwardly away from said line of pull and closer to the palm of a user, a downwardly extending portion, and an arcuate portion having an approximate midpoint positioned on said line of pull, whereby a bar positioned on said pair of hooks will remain at the approximate midpoint of said arcuate portions when lifted by said pair of hooks; wherein said at least one sleeve comprises plural sleeves each sleeve located at a different distance from said wrist strap whereby a user may insert a lifting hook member into a desired one of said plural sleeves to accommodate user's with different length hands and to allow a user to place the lifting hook member at a is most comfortable for the user location which.

2. A safety strap according to claim 1 further comprising a bar strap adapted to extend from the wrist strap over the palm and toward the finger tips of a user, whereby said bar strap may be spiraled around a bar to be lifted to aid the user in gripping and holding the bar.

3. A safety strap according to claim 2 wherein said lifting hook member is removed from said at least one sleeve.

4. A safety strap according to claim 1 wherein said lifting hook member is removably inserted into one of said at least one sleeves.

5. A safety strap according to claim 1 wherein said angled portion is oriented at an angle of approximate 40 degrees relative to said line of pull.

6. A safety strap according to claim 1 wherein said arcuate portion extends along an arcuate distance of at least approximately 130 degrees.

7. A safety strap according to claim 1 wherein said arcuate portion extends along an arcuate distance of approximately 180 degrees.

8. A safety strap according to claim 1 wherein said downwardly extending portion is spaced apart from and parallel to said line of pull.

9. A safety strap according to claim 1 wherein said downwardly extending portion is collinear with said line of pull.

10. A safety strap according to claim 1 wherein said wrist strap is removably secured to the wrist of a user with Velcro fasteners.

11. A safety strap according to claim 1 wherein said wrist strap and said tongue are formed of a flexible material.

12. A safety strap according to claim 1 wherein said wrist strap and said tongue are formed of a nylon fabric.

13. A safety strap according to claim 1 wherein said lifting hook member is formed of steel.

14. A safety strap according to claim 1 wherein said lifting hook member is adapted to be inserted into one of said at least one sleeve by pushing an end of one hook and the entire hook through the sleeve whereby the sleeve covers said central portion.

* * * * *